US006295804B1

(12) United States Patent
Burton et al.

(10) Patent No.: US 6,295,804 B1
(45) Date of Patent: Oct. 2, 2001

(54) PULSED THRUSTER SYSTEM

(75) Inventors: Rodney L. Burton; Gary Willmes, both of Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 09/176,495

(22) Filed: Oct. 21, 1998

Related U.S. Application Data

(60) Provisional application No. 60/081,346, filed on Apr. 9, 1998.

(51) Int. Cl.[7] ..... F03H 1/00
(52) U.S. Cl. ..... 60/203.1; 60/202
(58) Field of Search ..... 60/202, 203.1; 219/121.57, 121.54

(56) References Cited

U.S. PATENT DOCUMENTS

| | | | |
|---|---|---|---|
| 667,435 | | 2/1901 | Friese-Greene et al. . |
| 3,221,212 | | 11/1965 | Gorowitz et al. . |
| 3,239,130 | | 3/1966 | Naundorf, Jr. . |
| 3,360,682 | | 12/1967 | Moore . |
| 3,425,223 | | 2/1969 | Browning . |
| 3,447,322 | | 6/1969 | Mastrup . |
| 3,575,003 | | 4/1971 | Aldo . |
| 3,636,709 | | 1/1972 | LaRocca . |
| 4,397,147 | * | 8/1983 | Turchi ..... 60/202 |
| 4,800,716 | | 1/1989 | Smith et al. . |
| 4,821,508 | | 4/1989 | Burton et al. . |
| 4,866,929 | | 9/1989 | Knowles et al. . |
| 4,967,637 | | 11/1990 | Löffler et al. . |
| 4,995,231 | | 2/1991 | Smith et al. . |

(List continued on next page.)

FOREIGN PATENT DOCUMENTS

| | | |
|---|---|---|
| 3814331 | 9/1989 | (DE) . |
| 1037664 | 6/1962 | (GB) . |
| 1798937 | 2/1993 | (SU) . |
| 9615589 | 5/1996 | (WO) . |

OTHER PUBLICATIONS

Rizzoni, Principles and Applications of Electrical Engineering, 1993, Irwin (Burr Ridge, IL), pp. 474–477, 481.*

"Advanced Concepts", Spanjers, Aug. 1996.

"AFRL Electric Propulsion Lab Research", Spanjers, Aug., 1998.

"Performance Measurements and Energy Losses in a Low Power Pulsed Arcjet", Willmes and Burton, 1996.

"Preliminary Experiments on Pulsed Plasma Thrusters with Applied Magnetic Fields", Kimura et al., Apr. 1978.

"Pulsed Plasma Thruster Ignitor Plug Ignition Characteristics", Brady et al., Sep./Oct. 1983.

"Experimental Research of 20 joule PT", Han–Ji Wu and Xue–Zhang Feng, Sep./Oct. 1985.

"Inititating Characteristics of Ignition System of PPT", Han–Ji Wu, 1995.

Investigation of PPT's Power Conditioner, Wen–Xi Liu, 1993.

(List continued on next page.)

*Primary Examiner*—Charles G. Freay
*Assistant Examiner*—David J. Torrente
(74) *Attorney, Agent, or Firm*—Marshall, Gerstein & Borun

(57) ABSTRACT

A thruster system includes a power supply and a pulse forming circuit coupled to the power supply. The pulse forming circuit includes a capacitor and first and second diodes. The positively-charged plate of the capacitor is coupled to the anode of the first diode, the negatively-charged of the capacitor is coupled to the anode of the second diode, and the cathode of the first diode is coupled to the cathode of the second diode. A low-impedance thruster is coupled in parallel to the second diode.

16 Claims, 5 Drawing Sheets

U.S. PATENT DOCUMENTS

| | | | | |
|---|---|---|---|---|
| 5,065,073 | | 11/1991 | Frus . | |
| 5,170,623 | * | 12/1992 | Dailey et al. | 60/202 |
| 5,245,252 | | 9/1993 | Frus et al. . | |
| 5,352,861 | | 10/1994 | Steigerwald et al. . | |
| 5,359,180 | | 10/1994 | Park et al. . | |
| 5,414,238 | | 5/1995 | Steigerwald et al. . | |
| 5,425,231 | | 6/1995 | Burton . | |
| 5,611,947 | | 3/1997 | Vavruska . | |
| 5,924,278 | * | 7/1999 | Burton et al. | 60/203.1 |
| 6,029,438 | * | 2/2000 | Hosick | 60/202 |

OTHER PUBLICATIONS

"Recent Progress in Pulsed Vacuum–Arc Microthrustor Research", Gilmour et al., Jun. 1968.
"Analysis of Solid Teflon Pulsed Plasma Thruster", Vondra et al., Dec. 1970.
Aerospace Information Report, AIR 784A, Aug. 1975.
"Performance Improvements in Solid Fuel Microthrusters", Vondra et al., Jan. 1972.
"Behaviour of Quasi–Steady Ablative MPD Thrusters With Different Propellants", Paccani et al., 1995.
"Experimental Analysis of a Coaxial Solid–Propellant MPD Thruster with Segmented Anodes", Paccani, 1993.
"Quasistady Ablative Magnetoplasmadynamic Thruster Performance with Different Propellants", Paccani et al., Mar./Apr. 1998.
"Non–Steady Solid Propellant MPD Experimental Analysis Concepts", Paccani, Jul. 1990.
"Scale Effects on Solid Propellant MPD Thruster Performance", Paccani et al., Jul. 1998.
"Effects of Propellant and Electrode Geometry on Pulsed Ablative Plasma Thruster Performance", Palumbo et al., Mar. 1975.
The MIT Lincoln Laboratory Pulsed Plasma Thruster, Vondra et al., Nov. 1976.
"Effects of Propellant Geometry on PPT Performance", Kuang Yuan–Xhu, 1984.
"Anode–Nozzle Experimental Analysis in a Coaxial Non–Steady Solid Propellant MPD Thruster", Paccani, 1998.
Design of Solid–Propellant MPD Thrusters, Andrenucci et al., 1979.
"Electric Propulsion Research and Development in the USSR", Zhurin et al., 1976.
"A Study of a Cylindrical, Pulsed, Solid Fuel Microthruster", Seeglitz, 1970.

* cited by examiner

PULSED THRUSTER SYSTEM

This application claims benefit of U.S. provisional application Serial No. 60/081,346, filed Apr. 9, 1998, the complete disclosure of which is hereby incorporated by reference herein.

FIELD OF THE INVENTION

The present invention relates to a thruster system which delivers pulses of electric current to a propellant to energize the propellant to generate thrust, and in particular to the pulse forming circuitry and the structure of the thruster of such a system.

BACKGROUND OF THE INVENTION

A thruster is a device which energizes a propellant such that when the propellant is ejected from the thruster, momentum is generated to move the body to which the thruster is attached. Thrusters use many different kinds of mechanisms to energize the propellant, but one common type of thruster introduces an electric current to the propellant to energize the propellant. These electric thrusters are commonly used in man-made satellites.

Electric thrusters can generally be categorized into two groups: steady state thrusters and pulsed thrusters, Each has its advantages and disadvantages.

As the name suggests, a steady state thruster is a thruster wherein the propellant is energized by providing a steady state electrical current to the propellant. One such steady state thruster is shown in U.S. Pat. No. 5,352,861 to Steigerwald et al.

However, steady state thrusters may have several disadvantages. For instance, steady state thrusters may respond sluggishly to changes in their operational status. Steady state thrusters usually require several milliseconds for activation, and then several minutes to reach thermal equilibrium. Moreover, steady state electric thrusters are not ideal for applications requiring only a small thrust or short-duration thrust, because at power levels below a few hundred watts steady state thrusters are commonly unstable and inefficient.

The pulsed thruster applies a series of electric current pulses of limited duration (typically on the order of microseconds to milliseconds, with microseconds being common for the low energy thrusters under consideration here) to the propellant to energize the propellant. A sample schematic of a conventional pulsed thruster system 20 is shown in FIG. 1. The system 20 includes a low DC voltage primary power supply 22, a high DC voltage thruster power supply 24, a control circuit 26, an ignition circuit 28, an ignition device 30, a capacitor 32, and a thruster 34. The primary power supply 22 is coupled to the thruster power supply 24, which in turn is coupled to the ignition circuit 28 and selectively coupled to the capacitor 32. The ignition circuit 28 is coupled to the ignition device 30, such as a spark plug, and receives commands from the control circuit 26. The capacitor 32 is selectively coupleable across the thruster 34.

In operation, the primary power supply 22 provides power to the thruster power supply 24, which charges the capacitor 32. The capacitor 32, in turn, applies this voltage across the thruster 34, which has first and second spaced electrodes 38, 40. In accordance with a signal received from the control circuit 26, the ignition circuit 28 fires the ignition device 30. The firing of the ignition device 30 provides a sufficient amount of energy to cause an arc to form on the surface of the propellant 42 between the first and second electrodes 38, 40, thus completing the circuit with the capacitor 32.

The propellant 42 is introduced into the space 44 between the first and second electrodes 38, 40. The energy released from the arc formed between the first and second electrodes 38, 40 may cause the propellant 42 to change into a gaseous form, and particularly an ionized gaseous form known as plasma. The plasma exits the space 44 at high velocity to provide thrust. As the propellant 42 is heated, the propellant 42, which is in a solid or semi-solid form as shown, is advanced into the space 44 through the action of the force $F_S$, which represents the force provided by a spring (not shown) which abuts the surface of the propellant 42 to urge the propellant 42 into the space 44.

Pulsed thrusters have several advantages compared to steady state thrusters. For example, the time required to activate a pulsed thruster is generally shorter than for a steady state thruster. Pulsed thrusters may achieve thrust in a short time duration, typically microseconds, compared to the time in which a steady state thruster can be turned on and off, typically seconds. Pulsed thrusters also generally achieve a higher peak power level, resulting in high momentum impulses compared to steady state thrusters. Also pulsed thrusters can easily vary their average thrust level by varying the capacitor energy and the pulse rate (pulses per second). Further, the pulsed thruster is generally not unstable in lower power applications.

Nonetheless, pulsed thrusters have their disadvantages. For instance, the circuit elements used to provide the electrical discharge may be subjected to high stresses, and consequently may have a relatively short useful life.

Additionally, current ringing or oscillation can occur in the capacitor and the thruster. Ringing occurs when current continues to flow back and forth through the circuit after the initial discharge of the capacitor, energizing inductances in the lines connecting the capacitor 32 with the thruster 34. FIG. 2 shows a plot of two consecutive current oscillations (A and B) in the capacitor 32 associated with current pulse discharges at times t1 and t2, respectively for the circuit of FIG. 1. The vertical axis represents current level and the horizontal axis represents time, and a typical pulse length $T_C$ is illustrated.

Ringing can cause damage to the entire system 20. For example, ringing may result in the charging of the capacitor 32 against its normal polarity, which may increase the wear on the capacitor 32. Additionally, current reversal through the capacitor 32 can result in considerable energy loss, which degrades overall thruster efficiency and also increases capacitor wear. Further, the corresponding current oscillations through the thruster 34 tend to increase heating of the conductors 46, 48 which connect the capacitor 32 to the electrodes 38, 40 within the thruster 34 and to increase heating of the electrodes 38, 40, the thruster insulators (not shown) and the propellant 42. This increased heating tends to produce undesirable erosion of the electrodes 38, 40 and insulators within the thruster 34, potentially shortening their life. Further, ringing can result in reversal of thrust forces within the thruster, reducing both thrust and efficiency.

It has been suggested that the ringing in the system 20 may be reduced by coupling a diode in parallel with the capacitor 32 and the thruster 34. Specifically, such a solution is suggested by Kimura et al. in Preliminary Experiment on Pulsed Plasma Thrusters with Applied Magnetic Fields, presented at the 13th International Electric Propulsion Conference (1978). In particular, Kimura et al. suggest that the diode in parallel with the capacitor and the electrodes of the thruster may eliminate the oscillatory nature of the main discharge. This solution, however, still allows some undesirable reversal of current in the system.

Furthermore, in a conventional thruster system, as is shown, the impedance of the thruster 34 is significantly larger than the impedance of the capacitor 32 to ensure that most of the energy is delivered to the thruster 34 when the capacitor 32 discharges. Simply put, the capacitor 32 and the thruster 34 will participate in the energy distribution after the capacitor discharge in proportion to their relative impedances. Given that the capacitor is typically on the order of 10 mΩ, for 80% of the energy to be distributed to the thruster 34, the impedance of the thruster 34 must be on the order of 40 mΩ. The energy distributed to the capacitor is generally lost through heating of the capacitor 32.

However, increasing the impedance of the thruster 34 decreases the efficiency of the thrust production in the thruster 34. For a thruster 34 relying on electrothermal effects (the production of flat through creation of high pressure), increases in thruster impedance can result in excessive propellant ablation and reduced thruster exhaust velocity. For a thruster 34 relying on electromagnetic effects (the production of thrust through electromagnetic forces), increases in thruster impedance can also result in decreased thrust per pulse. For a thruster 34 relying on both electrothermal effects and electromagnetic effects, the effects may be cumulative.

SUMMARY OF THE INVENTION

According to an aspect of the present invention, a thruster system includes a power supply and a pulse forming circuit coupled to the power supply. The pulse forming circuit includes a capacitor and first and second diodes. The positivey-charged plate of the capacitor is coupled to the anode of the first diode, the negatively-charged of the capacitor is coupled to the anode of the second diode, and the cathode of the first diode is coupled to the cathode of the second diode. A thruster is coupled in parallel to the second diode.

Additionally, an inductor may be coupled between the cathodes of the first and second diodes and the thruster.

Further, the thruster may include a diverging nozzle which is at least in part non-ablating and substantially electrically insulating and which has an outlet end, a first, cylindrical electrode coupled to the cathodes of the first and second diodes and projecting through the nozzle with a first end of the first electrode extending past the outlet end of the nozzle, and a second annular electrode coupled to the anode of the second diode, disposed adjacent to the outlet end of the nozzle, and having a central axis, the first electrode disposed along the central axis of the second electrode.

According to another aspect of the present invention, a thruster system includes a power supply and a pulse forming circuit coupled to the power supply. The pulse forming circuit includes a capacitor and a first diode, the positively-charged plate of the capacitor coupled at a first junction to the cathode of the diode and the negatively-charged plate of the capacitor coupled at a second junction to the anode of the diode. A thruster is also provided, including a body and a diverging nozzle which is attached to the body, is at least in part non-ablating and substantially electrically insulating, and has a first end and an outlet end. A first, central electrode is coupled to the first junction and projects through the nozzle with a first end of the first electrode to extend past the outlet end of the nozzle, and a second electrode is coupled to the second junction and disposed adjacent to the outlet end of the nozzle. A propellant is disposed at the first end of the diverging nozzle.

The thruster system may also include a second diode having an anode coupled to the positively-charged plate of the capacitor and a cathode coupled to the first junction. Also, an inductor may be coupled between the first junction and the first electrode.

Further, the first electrode may be a cylindrical electrode, the second electrode may be an annular electrode having a central axis, and the first electrode may be disposed along the central axis of the second electrode. Moreover, the first electrode may have an effective outer diameter, the second electrode may have an effective inner diameter, and the ratio of the inner diameter of the second electrode to the outer diameter of the first electrode may be not greater than 10:1.

Additionally, the body may have a passage formed therein in communication with the first end of the nozzle, and the propellant, which may be a non-gaseous, non-liquid propellant—such as the polymer sold under the trademark Teflon, may be disposed in the passage. The passage may have an axis and the first electrode may have an axis, and the axis of the passage and the axis of the first electrode may be parallel to each other. Alternatively, the passage may have an axis and the first electrode may have an axis, and the axis of the passage and the axis of the first electrode may be transverse to each other.

Also, the thruster may have an impedance which is on the order of 10–15 mΩ.

DETAILED DESCRIPTION OF THE PREFERRED EMBODIMENT

Figure 3:
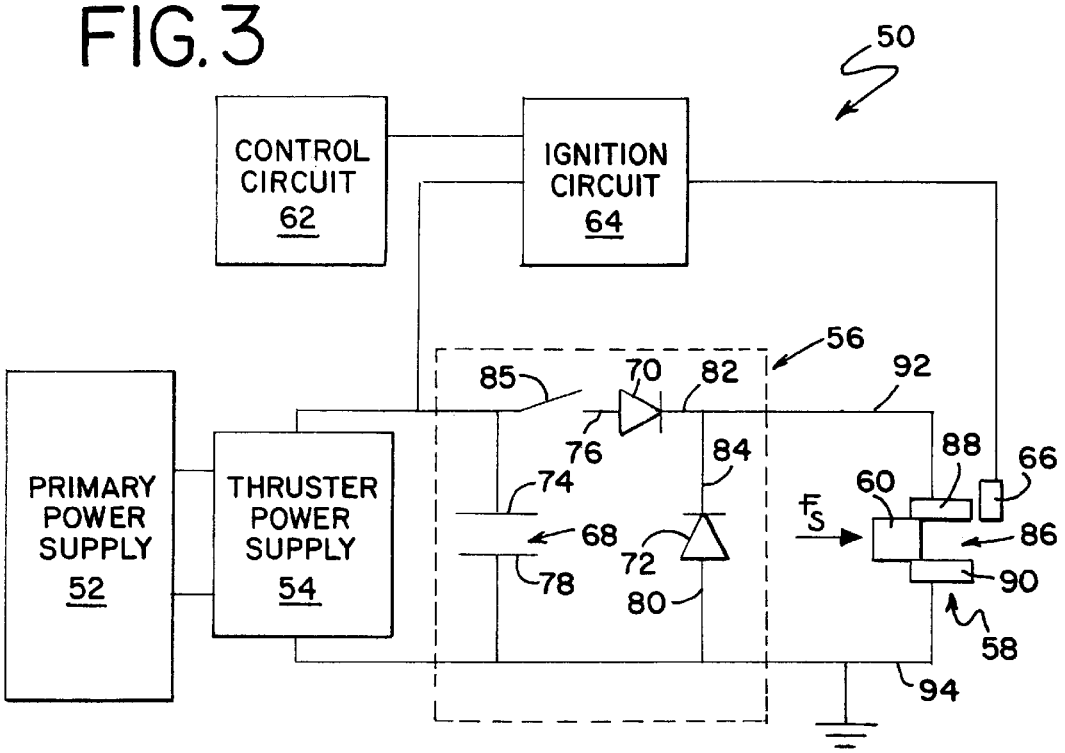
FIG. 3 is a block diagram of a pulsed thruster system according to the present invention.

FIG. 3 depicts a pulsed thruster system 50 according to the present invention. The system 50 includes a primary power supply 52, a thruster power supply 54, a pulse forming circuit 56, and a thruster 58. The primary power supply 52 is coupled to the thruster power supply 54, which in turn is coupled to the pulse forming circuit 56. The pulse forming circuit 56 is coupled to the thruster 58 to deliver current pulses to the thruster 58 to provide thrust of a selected duration by energizing a propellant 60. Additionally, a control circuit 62, an ignition circuit 64 and an ignition device 66 may be provided to introduce a spark which will cause an arc to form in the thruster 58.

As shown, the pulse forming circuit 56 according to the present invention includes three elements: a capacitor 68, a first diode 70 and a second diode 72. The capacitor 68 has a first positively-charged plate 74 which is coupled to the first contact (anode) 76 of the first diode 70. The capacitor 68 also has a second negatively-charged plate 78 which is coupled to the first contact (anode) 80 of the second diode 72. The second contacts (cathodes) 82, 84 of the first and second diodes 70, 72 are coupled together. A switch 85, coupled to control circuitry (not shown), may be coupled between the plate 74 of the capacitor 68 and the anode 76 of the diode 70 such that it is in the open state while the capacitor 68 is charging, the switch 85 being closed when the capacitor 68 is to be discharged to the thruster 58.

In operation, the capacitor 68 is charged by the thruster power supply 54 to a predetermined voltage. At a predetermined time, the control circuit 62 sends a signal to the ignition circuit 64 to activate the ignition device 66, which may be a spark plug. The ignition device 66 provides a spark in or adjacent to a space 86 defined by first and second electrodes 88, 90 of the thruster 58, the propellant 60 and the insulators (not shown) of the thruster 58. This spark causes an arc to form across the space 86, completing the circuit between the pulse forming circuit 56 and the thruster 58. The system 50 may be configured to provide pulses to the thruster 58 with a current flow for each pulse in the range of about 100 to 50,000 amperes for a duration of at least 250 nanoseconds. The arc thus generated causes the propellant 60 to change to form ionized gas or plasma, which is ejected from the thruster 58 to produce thrust.

Figure 4:
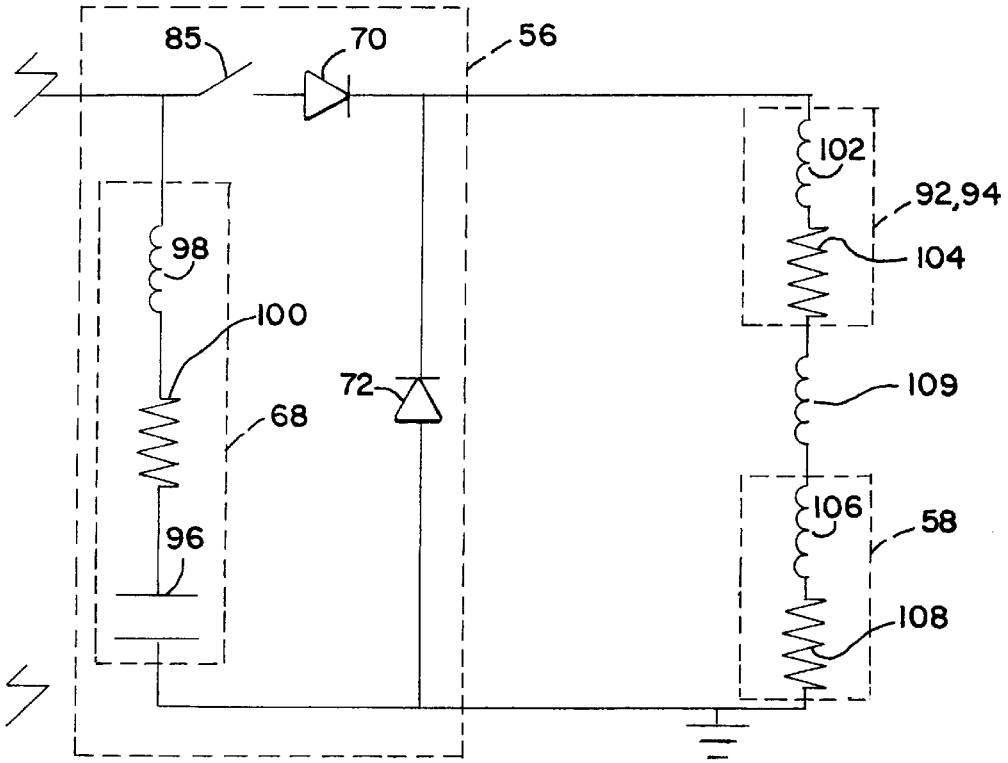
FIG. 4 is a circuit schematic of an equivalent circuit for the pulse forming circuit and the thruster shown in FIG. 3.

After the capacitor 68 initially discharges to the thruster 58, the intrinsic inductances in lines 92, 94 (which connect the pulse forming circuit 56 to the thruster 58) and in the thruster 58 cause the current which flows from the capacitor 68 to the thruster 58 to continue to flow. To better illustrate this point, FIG. 4 shows an equivalent circuit to the circuit shown in FIG. 3, wherein the intrinsic capacitance, inductance and resistance 96, 98 100 of the capacitor 68, the intrinsic inductance (on the order of 10 nanohenrys) and resistance 102, 104 of the lines 92, 94, and the intrinsic inductance and resistance 106, 108 of the thruster 58 is shown. Additional inductors (represented by an inductor 109, on the order of 300 nanohenrys) may be added between the diodes 70, 72 and the thruster 58. As the capacitor 68 discharges, the intrinsic inductances 102, 106 of the lines 92, 94 and thruster 58 and the inductor 109 charge, such that when the capacitor 68 has discharged, the inductors 102, 106, 109 seek to maintain a current flowing through the lines 92, 94 and the thruster 58.

The second diode 72, however, provides a lower impedance path for the current to follow in response to polarity reversal in excess of a corresponding diode voltage drop. The diode 72 thus diverts at least a portion of the current which would otherwise flow through the capacitor 68 during the "negative" or reversed voltage polarity portion of the pulse oscillations which typically occur without the diode 72. As a consequence, the second diode 72 limits reverse bias charging in the capacitor 68, and instead directs the current back through the thruster 58 to generate thrust.

Over time, the current flowing as a consequence of the intrinsic inductances of the thruster 58 and lines 92, 94 would change direction. To prevent this current from flowing through the capacitor 68 and the thruster 58, the first diode 70 prevents current flow in a direction opposite to the original direction which occurs during discharge of the capacitor 70. In this fashion, the thruster system 50 according to the present invention avoids charging of the capacitor 68 except from the thruster power supply 54, and limits overheating of the thruster 58 by the oscillatory nature of the current pulse found in conventional thruster systems.

Figure 1:
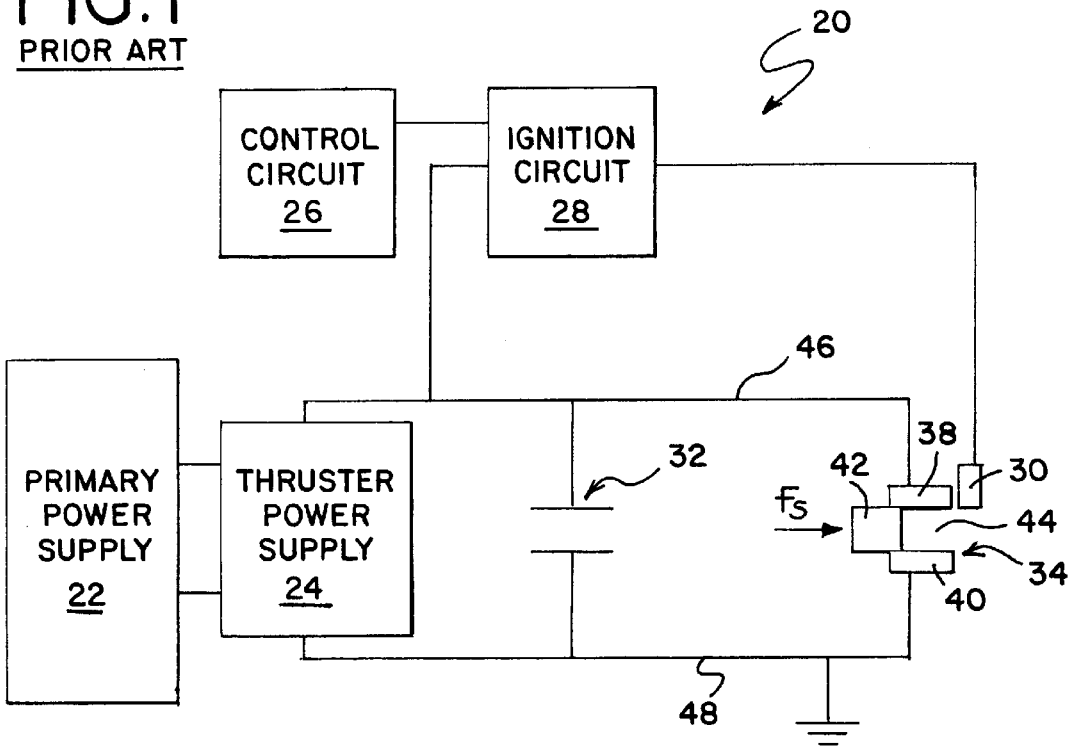
FIG. 1 PRIOR ART
FIG. 1 is a block diagram of the circuitry of a conventional pulsed thruster system.
Figure 2:
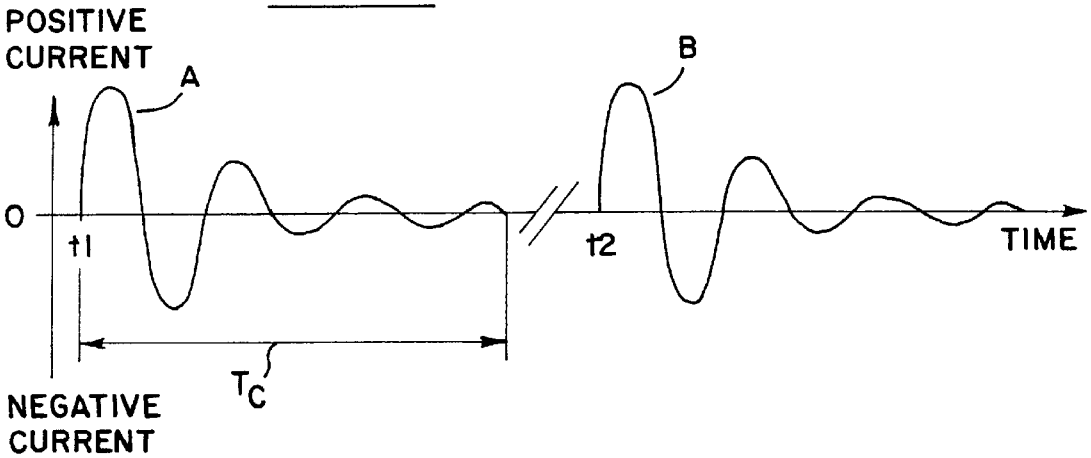
FIG. 2 PRIOR ART
FIG. 2 is a plot showing the oscillation or ringing of current in the capacitor of the thruster system shown in FIG. 1.
Figure 5:
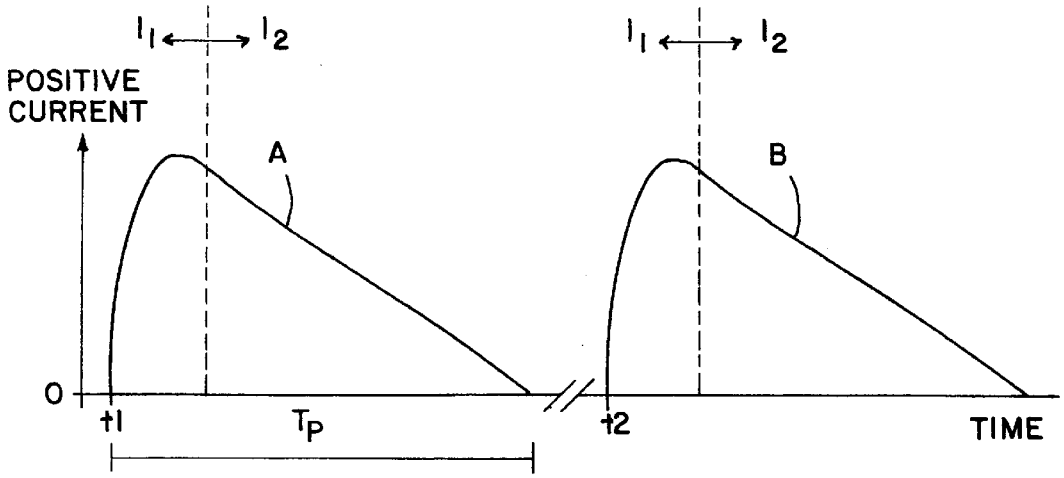
FIG. 5 is a plot showing the current waveform in the thruster shown in FIG. 3.

FIG. 5 shows the current waveform through thruster 58 for two consecutive current pulses (A and B) initiated at times t1 and t2, respectively. The vertical axis represents current level and the horizontal axis represents time. Notably, the undesirable oscillations depicted in FIG. 2 are absent. Instead, a current is provided in a single direction thereby increasing the thrust outputted from the thruster 58. The duration of the current pulse is increased by increasing the inductance, for example, through the inclusion of the inductor 109 between the diodes 70, 72 and the thruster 58 or by increasing the intrinsic inductance of the lines 92, 94.

The structure and operation of the thruster system 50 is now discussed in greater detail with respect to FIG. 3. Starting with the primary power supply 52, it will be recognized that primary power supply 52 could be a power source internal to a spacecraft that is propelled by the thruster system 50. The primary power supply 52 may provide a regulated 28 volt output using conventional techniques, such as solar cells or batteries. However, it is not necessary that the primary power supply 52 be a regulated power supply, and, in fact, the output of the power supply 52 may be unregulated according to the present invention.

The thruster power supply 54 provides a desired electric potential from the primary power supply 52 to the pulse forming circuit 56 and the ignition circuit 64. For example, the thruster power supply 54 may include a DC-to-DC converter of the flyback variety to provide at least a 300 volt output from a nominal 28 volt input. Alternatively, the thruster supply 54 may be configured to operate with an unregulated input voltage in a range of about 10 to 36 volts.

Figure 6:
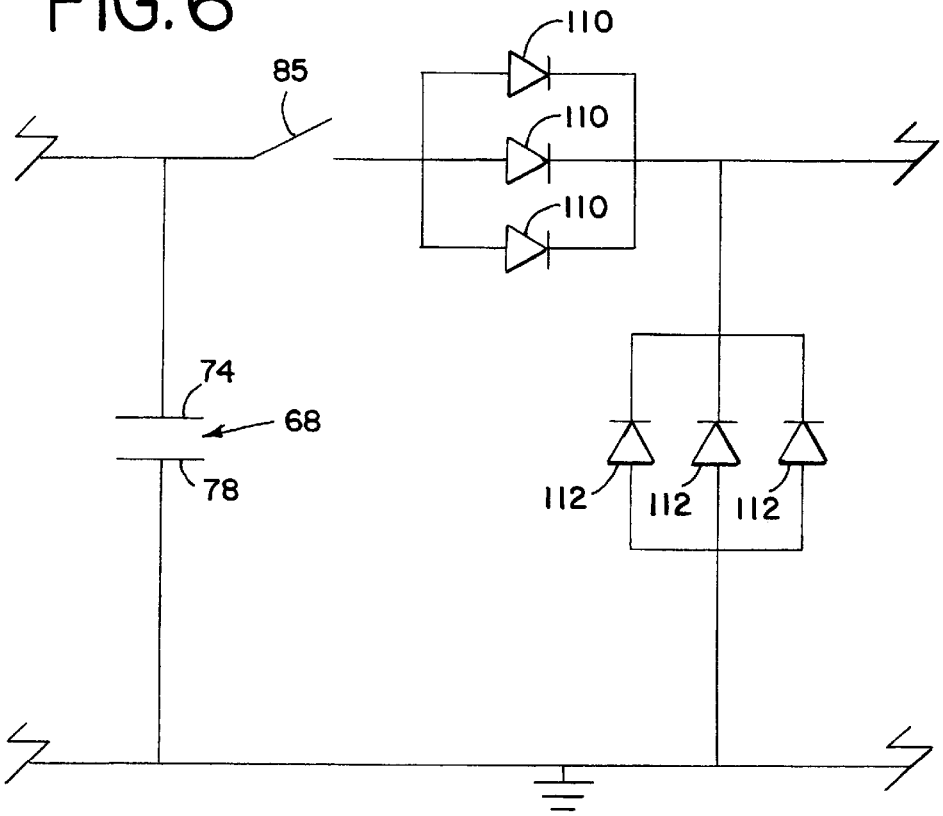
FIG. 6 is a circuit schematic of an alternative pulse forming circuit.

The pulse forming circuit 56, as represented previously, includes the capacitor 68 and the first and second diodes 70, 72. The pulse forming circuit 56 may be configured as a conventional capacitor of suitable construction, or a number of such capacitors in parallel. Similarly, the pulse forming circuit 56 may be configured as a conventional diode of suitable construction, or, preferably, a number of such diodes in parallel. An alternative circuit 108 is shown as FIG. 6, wherein the first and second diodes 70, 72 are shown as the parallel combination of a number of individual diodes 110, 112.

The power transmission lines 90, 92 which couple the pulse forming circuit 56 to the thruster 58 may be provided by twin leads of low electrical resistance. Alternatively, the lines 90, 92 may be flat plates, coaxial cable, metal tubes, inductors or such other low resistance electrical coupling as would occur to one skilled in the art.

The pulse forming circuit 56 according to the present invention is not limited in its usefulness to a specific type of thruster. In fact, the pulse forming circuit 56 may be used with a variety of pulsed thrusters, including, but not limited to, pulsed arcjet thrusters, pulsed plasma thrusters, and pulsed magnetoplasmadynamic thrusters. Additionally, the usefulness of the circuit 56 is not dependent on the arrangement of the electrodes 88, 90, which may be, for example, parallel or coaxial. Moreover, the propellant 60 may be breech-fed or side-fed into the space 86, and may be stored in the form of a gas, liquid, solid or semi-solid suitable for the particular type of thruster selected.

Figure 7:
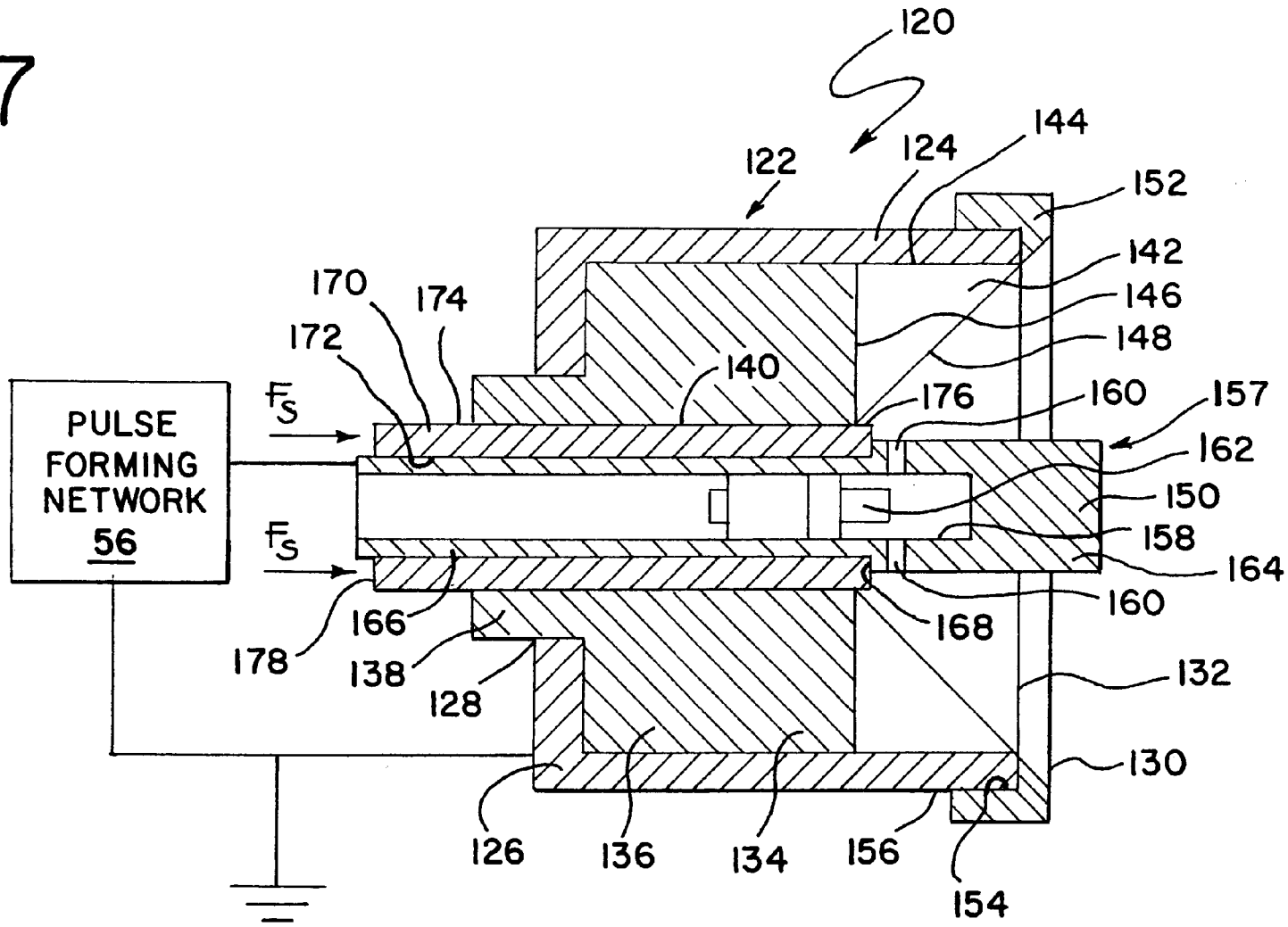
FIG. 7 is a cross-sectional view of a low-impedance thruster for use with the thruster system according to the present invention.
Figure 8:
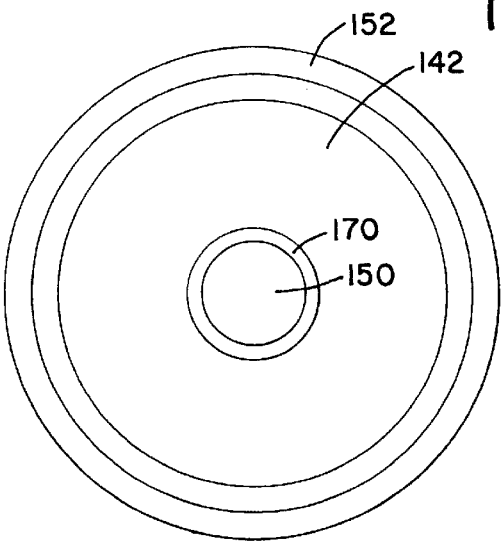
FIG. 8 is a frontal view of the thruster shown in FIG. 7.

While the usefulness of the pulse forming circuit 56 is not limited by the choice of the thruster 58, according to another aspect of this invention, a thruster is provided which has a lower impedance (on the order of 10 to 15 mΩ) than conventional thrusters (on the order of 30 to 40 mΩ). It is possible to have a lower impedance thruster 58 because a) the energy distribution to the thruster 58 is proportional to the relative impedances of the thruster 58 and the second diode 72, rather than the relative impedances between the thruster 58 and the capacitor 68, and b) the diode has a much smaller impedance (conventionally on the order of 1 mΩ) relative to the capacitor (on the, order of 10 mΩ). One such lower impedance thruster 120 is shown in FIGS. 7 and 8.

The thruster 120 has a cylindrical housing 122 with a side wall 124 of annular cross-section and a circular rear wall 126 with an opening 128 defined therethrough aligned with the center of the rear wall 126. An edge 130 of the side wall 124 defines a second opening 132 aligned with the opening 128 in the rear wall 126. The cylindrical housing 122 is made of an electrically conductive material.

The side wall 124 bounds a cylindrical space in which is disposed a stepped, cylindrical spacer 134. The cylindrical spacer 134 has a first cylindrical region 136 of a first diameter and a second cylindrical region 138 of a second diameter which is smaller than the first diameter of the first cylindrical region 136. The second cylindrical region 138 is aligned with and disposed through the opening 128 defined in the rear wall 126 of the cylindrical housing 122. The cylindrical spacer 134 also has a bore 140 therethrough, the axis of the bore 140 being aligned with the center of the rear wall 126. The spacer 134 is made of an electrically insulative material.

A nozzle element 142 is also disposed within the housing 122, with an outer side surface 144 abutting the side wall 124 of the housing 122, and an outer rear surface 146 abutting the spacer 134. The nozzle element 142 also has an inner surface 148, which defines a diverging nozzle through which plasma exiting from the thruster 120 passes as it accelerates. The nozzle element 142 may be made of an electrically insulative and non-ablating or ablation-resistant material, such as boron nitride.

The thruster 120 also has a pair of electrodes 150, 152 between which the arc is generated which causes the propellant material to be heated. The electrode 150 is a stepped, cylindrical electrode, while the electrode 152 is an annular, ring electrode. It is believed that the ratio of the inner diameter of the second electrode 152 to the outer diameter of the first electrode 150 should not be greater than 10:1. The electrodes 150, 152 are preferably made of a low work function material, such as 2% thoriated tungsten.

The electrode 150 is fitted through the bore 140 in the spacer 134. The electrode 152 is secured to the housing 122, for example through the use of threads on the inner surface 154 of the electrode 152 and the outer surface 156 of the housing 122, although other attachment mechanisms could be used as would be recognized by one of ordinary skill in the art. As shown, the axis of the first electrode 150 is aligned with the axis of the second electrode 152, with the end 157 of the first electrode 150 projecting slightly through the ring electrode 152.

The cylindrical electrode 150 has a bore 158 and openings 160 formed therethrough. The openings 160 are in communication with the bore 158. An ignition device 162, such as a spark plug, is disposed in the bore 158 such that a spark generated by the ignition device can pass through the openings 160 into the diverging nozzle defined by the inner surface 148. The ignition device 162, as would be recognized by one of ordinary skill in the art, would be coupled to the ignition circuit, such as the ignition circuit 64.

As mentioned previously, the cylindrical electrode 152 is a stepped electrode with a first, cylindrical region 164 having a first diameter and a second, cylindrical region 166 having a second diameter smaller than the first diameter. It is believed that the diameter of the first region 164 should be greater than 1 mm. A shoulder 168 is formed where the first region 164 is attached to the second region 166. This shoulder 168 is disposed slightly (1–2 mm) in the direction of the second electrode 152 relative to the interface between the spacer 134 and the nozzle element 142.

A tubularly shaped propellant 170, for example the polymer sold under the trademark Teflon, is disposed in the bore 140 in the spacer 134, between the spacer 134 and the electrode 150. The diameter of the inner surface 172 of the propellant 170 is slightly larger than the diameter of the outer surface of the second cylindrical region 166 of the first electrode 150, while the diameter of the outer surface 174 of the propellant 170 is slightly smaller that the diameter of the bore 140. The propellant 170 is disposed in between the spacer 134 and the electrode 150 such that a front end 176 of the propellant 170 abuts the shoulder 168 of the electrode 150, maintaining the longitudinal position of the propellant 170 relative to the first and second electrodes 150, 152. The propellant 170 is urged forward by a spring (not shown) which applies a spring force, $F_S$, to a rear end 178 of the propellant 170.

The thruster 120 operates by creating an arc between the first and second electrodes 150, 152 such that the propellant 170, or more particularly the front end 176 of the propellant 170, is heated. The heated propellant forms a plasma within the nozzle element 142, and exits the nozzle element 142 under the influence of a force generated by the pressure of the plasma within the nozzle element 142 and the electromagnetic effects of the current flowing between the first and second electrodes 150, 152.

It is thought that the impedance of the thruster 120 is less than that of a conventional coaxial plasma thruster because the arc current flowing between the first and second electrodes 150, 152 does not have to traverse the inner surface 148 of the nozzle element 142. In a conventional coaxial thruster, the front end of the central electrode extends no further than the rear surface 146 of the nozzle element 142. In this configuration, the current path is directed along the surface 148 of the nozzle element 142, wherein the electrons are cooled by proximity to the relatively cool wall of the nozzle element 142. The cooling of the electrons causes the resistivity of the current path to increase, increasing the overall impedance of the conventional thruster.

In the thruster 120, because the front end 157 of the first electrode 150 extends through the exit plane defined by the second electrode 152, the current path is principally between the region of the first electrode 150 proximate to the front end 157. The electrons therefore follow a current path which is spaced from the cool walls of the nozzle element 142. This increases the conductivity of the current path between the electrodes 150, 152.

More particularly, this configuration decreases the overall impedance of the thruster by decreasing the resistive portion of the impedance. In a thruster such as the thruster 120, wherein the thrust is produced by electromagnetic and electrothermal forces, it may be easier to avoid excessive propellant ablation and velocity reduction.

Figure 10:
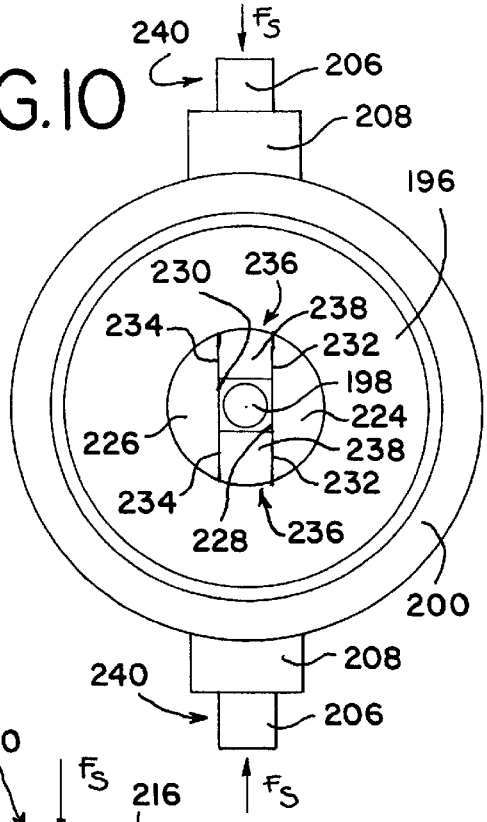
FIG. 10 is a frontal view of the thruster shown in FIG. 9.
Figure 9:
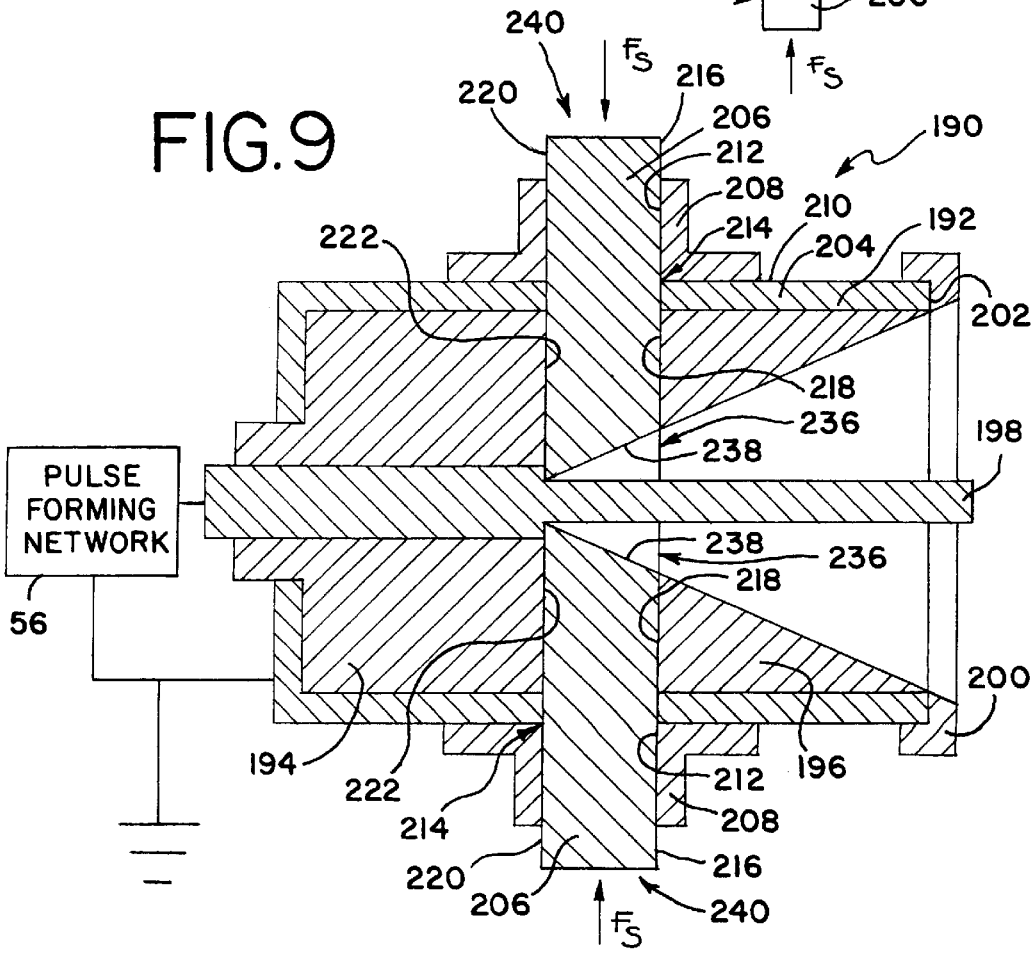
FIG. 9 is a cross-sectional view of a further, alternative thruster for use with the thruster system according to the present invention.

An alternative thruster 190 is shown in FIGS. 9 and 10. The thruster 190 shares many elements in common with the thruster 120; however, the thruster 190 is a side-fed thruster, as opposed to the breech-fed thruster 120 described above. Consequently, the discussion is directed to the differences in the feed mechanism, rather than to the entire structure of the thruster 190.

As will be recognized, the thruster 190 has a housing 192, a spacer 194, a nozzle element 196 and first and second electrodes 198, 200. The housing 192 defines a space wherein the spacer 194 and the nozzle element 196 are disposed. The spacer 194 has a bore 197 therethrough in which the first electrode 198 is disposed. The second electrode 200 is attached to a front end 202 of a side wall 204 of the housing 192 by a conventional attachment mechanism, such as a threaded attachment mechanism. The housing 192 and the electrodes 198, 200 are made of a conductive material, while the spacer 194 is made of an insulative material and the nozzle element 196 is made of an insulative and non-ablating or ablation-resistant material.

As was noted above, the thruster 190 is a side-fed, rather than a breech-fed, thruster. Specifically, a solid propellant 206 is fed in rectangular bar form through brackets 208 attached to an outer surface 210 of the side wall 204 of the housing 192. The bracket 208 has a rectangular bore 212 which is aligned with an opening 214 in the outer surface 210 of the side wall 204 of the housing 192, and through which the solid propellant 206 is fed.

Alignment of the propellant 206 within the housing 192 is maintained in the following fashion. The propellant 206 has a front edge 216 which abuts a rear surface 218 of the nozzle element 196 and a rear edge 220 which abuts a frontal surface 222 of the spacer 194. D-shaped spacers 224, 226 (FIG. 10) are disposed in the housing 192, and have surfaces 228, 230 which abut surfaces 232, 234 of the propellant 206. The abutting relationship between the spacer 194, nozzle element 196, D-shaped spacers 224, 226 and the propellant 206 substantially limits movement of the propellant 206 except radially relative to the first electrode 198.

As will be noted, a first end 236 of the propellant 206 is angled, such that it abuts the first electrode 198 over a limited area. The first end 220 of the propellant is thus angled to permit the entire surface 238 of the propellant 206 to be heated, rather than confining the heating of the propellant to one side. As a consequence, as the propellant 206 is heated, the propellant 206, which has a spring force ($F_S$) applied to a second end 240 thereof by a spring (not shown), will advance into the thruster 190 to maintain the supply of propellant 206 to the thruster 190.

The lower impedance thruster can also be of other forms than coaxial, as shown. For example, rectangular thrusters using plane-parallel electrodes with either breech—or side-fed propellant could also be used to provide a lower impedance thruster according to the teachings of the present invention.

Still other aspects, objects, and advantages of the present invention can be obtained from a study of the specification, the drawings, and the appended claims.

We claim:

1. A thruster system comprising:

a power supply;

a pulse forming circuit coupled to the power supply, the pulse forming circuit comprising a capacitor and first and second diodes, the positively-charged plate of the capacitor coupled to the anode of the first diode, the negatively-charged plate of the capacitor coupled to the anode of the second diode, and the cathode of the first diode coupled to the cathode of the second diode at a junction; and a thruster having a first electrode coupled to the junction and a second electrode coupled to the negatively-charged plate of the capacitor.

2. The thruster system according to claim 1, further comprising an inductor coupled between the cathodes of the first and second diodes and the thruster.

3. The thruster system according to claim 2, wherein the thruster comprises:

a diverging nozzle which is at least in part non-ablating and substantially electrically insulating and which has an outlet end;

the first electrode comprises a first, cylindrical electrode coupled to the cathodes of the first and second diodes and projecting through the nozzle with a first end of the first electrode extending past the outlet end of the nozzle; and the second electrode comprises a second, annular electrode coupled to the anode of the second diode, disposed adjacent to the outlet end of the nozzle, and having a central axis, the first electrode disposed along the central axis of the second electrode.

4. A thruster system comprising:

a power supply;

a pulse forming circuit coupled to the power supply, the pulse forming circuit comprising a capacitor and a first diode, the positively-charged plate of the capacitor coupled at a first junction to the cathode of the diode and the negatively-charged plate of the capacitor coupled at a second junction to the anode of the diode;

a thruster comprising a body, a diverging nozzle which is attached to the body, is at least in part non-ablating and substantially electrically insulating, and has a first end and an outlet end, a first, central electrode coupled to the first junction and projecting through the nozzle with a first end of the first electrode to extend past the outlet end of the nozzle, and a second electrode coupled to the second junction and disposed adjacent to the outlet end of the nozzle; and a propellant at the first end of the diverging nozzle.

5. The thruster system according to claim 4, further comprising a second diode having an anode coupled to the positively-charged plate of the capacitor and a cathode coupled to the first junction.

6. The thruster system according to claim 5, further comprising an inductor coupled between the first junction and the first electrode.

7. The thruster system according to claim 4, wherein:

the first electrode comprises a cylindrical electrode; and the second electrode comprises an annular electrode having a central axis, the first electrode disposed along the central axis of the second electrode.

8. The thruster system according to claim 7, wherein:

the first electrode has an effective outer diameter; and the second electrode has an effective inner diameter, the ratio of the inner diameter of the second electrode to the outer diameter of the first electrode being not greater than 10:1.

9. The thruster system according to claim 4, wherein:

the body has a passage formed therein in communication with the first end of the nozzle; and the propellant is disposed in the passage.

10. The thruster system according to claim 9, wherein the passage has an axis and the first electrode has an axis, and the axis of the passage and the axis of the first electrode are parallel to each other.

11. The thruster system according to claim 9, wherein the passage has an axis and the first electrode has an axis, and the axis of the passage and the axis of the first electrode are transverse to each other.

12. The thruster system according to claim 9, wherein the propellant comprises a non-gaseous, non-liquid propellant.

13. The thruster system according to claim 12, wherein the propellant comprises Teflon.

14. The thruster system according to claim 4, wherein thruster has an impedance which is on the order of 10–15 mΩ.

15. The thruster system according to claim 1, wherein the pulse forming circuit further composes a third diode having a anode coupled to the positively-charged plate of the capacitor and a cathode coupled to the junction.

16. The thruster system according to claim 1, wherein the pulse forming circuit further comprises a third diode having a anode coupled to the negatively-charged plate of the capacitor and a cathode coupled to the junction.

* * * * *